United States Patent [19]

Ridley

[11] Patent Number: 4,678,593

[45] Date of Patent: Jul. 7, 1987

[54] TRANSPARENT OR TRANSLUCENT TOILET BARS CONTAINING A SMECTITE-TYPE CLAY

[75] Inventor: Gordon Ridley, Cramlington, England

[73] Assignee: The Procter & Gamble Company, Cincinnati, Ohio

[21] Appl. No.: 889,452

[22] Filed: Jul. 23, 1986

[30] Foreign Application Priority Data

Jul. 26, 1985 [GB] United Kingdom ..... 8518910

[51] Int. Cl.[4] ..... C11D 9/18; C11D 9/20; C11D 10/04; C11D 17/00

[52] U.S. Cl. ..... 252/131; 252/121; 252/134; 252/174; 252/174.25; 252/DIG. 5; 252/DIG. 16

[58] Field of Search ..... 252/121, 131, 134, 174, 252/174.25, DIG. 5, DIG. 16

[56] References Cited

U.S. PATENT DOCUMENTS

| | | | |
|---|---|---|---|
| 2,686,761 | 8/1954 | Ferguson | 252/109 |
| 2,970,116 | 1/1961 | Kelly et al. | 252/368 |
| 3,708,428 | 1/1973 | McDonald | 252/109 |
| 3,728,446 | 4/1973 | Roberts | 424/49 |
| 3,789,011 | 1/1974 | Tanaka | 252/131 |
| 3,793,214 | 2/1974 | O'Neill | 252/117 |
| 3,946,108 | 3/1976 | Tomilinson | 424/49 |
| 4,020,154 | 4/1977 | Perla | 424/49 |
| 4,165,293 | 8/1979 | Gordon | 252/118 |
| 4,256,600 | 3/1981 | Lewis | 252/132 |
| 4,290,904 | 9/1981 | Poper | 252/118 |
| 4,297,230 | 10/1981 | Rasser | 252/117 |
| 4,493,786 | 1/1985 | Joshi | 252/368 |
| 4,557,853 | 12/1985 | Collins | 252/128 |

FOREIGN PATENT DOCUMENTS

| | | |
|---|---|---|
| 93011 | 11/1983 | European Pat. Off. . |
| 2083490 | 3/1982 | United Kingdom . |
| 2127426 | 4/1984 | United Kingdom . |

OTHER PUBLICATIONS

Camay Soap—For Oily Skin, on sale 1983.

*Primary Examiner*—Dennis L. Albrecht
*Attorney, Agent, or Firm*—Ronald L. Hemingway; Richard C. Witte

[57] ABSTRACT

Transparent or translucent toilet compositions in bar form incorporating a smectite-type clay. The compositions are preferably milled toilet bars and demonstrate improved skin conditioning performance on oily skin types together with excellent bar appearance.

8 Claims, No Drawings

TRANSPARENT OR TRANSLUCENT TOILET BARS CONTAINING A SMECTITE-TYPE CLAY

TECHNICAL FIELD

This invention relates to toilet compositions in the form of bars, tablets, sticks and the like. In particular, it relates to soap or soap/synthetic compositions in bar form for toiletry purposes delivering improved skin conditioning and cosmetic benefits, especially an oily-type skin, together with excellent visual aesthetics.

BACKGROUND

A wide variety of soap bar compositions and manufacturing processes are known in the art. Commonly, soap bar compositions for toiletry purposes are milled soaps of low moisture content (from about 5% to about 18% water) based on a mixture of tallow and coconut oil feedstocks. Bars having milled soap characteristics can also be prepared from soap of a high moisture content, as described for example in U.S. Pat. Nos. 2,686,761 and 2,970,116 by mechanically working the soap at a temperature of from about 80° F. to 125° F. and by using an appropriate fat feedstock. Such a process has two main advantages; firstly, it is relatively energy-efficient in that less drying of the neat-kettle soap is required; and secondly, it produces soap bars having desirable translucency or transparency as a result of beta-phase soap formation.

From the consumer acceptance viewpoint, of course, the skin conditioning performance and cosmetic attributes of a toilet bar composition are highly important and there is a continuing need to improve these aspects of performance. One particular area where conventional soap bar formulations have been deficient is in cleansing of skin of a typically oil nature, many people within this category finding that conventional products fail to deal with the oiliness problem with the result that the skin develops an excessively shiny appearance. This in turn is viewed as evidence of poor skin condition.

Although a number of additive materials have been identified which can enhance oily skin condition, a major constraint on the use of such materials in beta-phase transparent or translucent bars is that there is no impairment of the physical, performance and aesthetic characteristics of the bar.

It has now been discovered that the addition of certain smectite-type clay materials to toilet bars of the transparent or translucent variety not only has a beneficial effect on oily (or oily/dry combination) skin condition but that the improvement is achieved without detriment to toilet bar performance (lathering, mildness, smear etc), physical characteristics (beta-phase formation) and above all, bar aesthetics (transparency or transluency).

Although the use of clay materials in detergent bars is already known on the art(eg GB-A-2083490, GB-A-2083491 and GB-A-2127426), there has apparently been no previous disclosure of transparent or translucent bars for personal cleansing containing the specified clay materials for improving oily skin condition.

SUMMARY OF THE INVENTION

Accordingly, the present invention provides a toilet bar composition comprising a transparent or translucent soap or soap/synthetic toilet bar composition incorporating smectite-type clay.

As used herein, the term toilet bar includes both conventional soap bar compositions and also mixed soap/-synthetic bar compositions. Preferred compositions contain from about 45% to about 95% of soluble alkali metal soap of $C_8$–$C_{24}$, preferably $C_{10}$–$C_{20}$ fatty acids and from 0% to 45% of a synthetic anionic surfactant. In highly preferred compositions, the soap component constitutes from about 55% to about 88% and the synthetic anionic surfactant from about 0% to about 35% by weight of the composition. Especially preferred are milled toilet bar compositions which are essentially unbuilt (i.e. contains less than about 5% of a water-soluble surfactancy builder).

All percentages and ratios herein are by weight, unless otherwise specified.

Fatty acid soaps suitable for use herein can be obtained from natural sources such as, for instance, plant or animal esters (e.g., palm oil, coconut oil, babassu oil, soybean oil, castor oil, tallow, whale or fish oils, grease, lard, and mixtures thereof). The fatty acid soaps can also be synthetically prepared (e.g., by the oxidation of petroleum, or by the hydrogenation of carbon monoxide by the Fischer-Tropsch process). Resin acids, such as those present in tall oil, may be used. Naphthenic acids are also suitable.

Sodium and potassium soaps can be made by direct saponification of the fats and oils or by the neutralization of the free fatty acids which are prepared in a separate manufacturing process. Particularly useful in the present invention are the sodium and potassium salts of mixtures of fatty acids derived from coconut oil and tallow, i.e., sodium and potassium tallow and coconut soaps.

Tallow fatty acids can be derived from various animal sources and generally comprise about 1% to 8% myristic acid, about 21% to 32% palmitic acid, about 14% to 31% stearic acid, and 0% to 4% palmitoleic acid, about 36% to 50% oleic acid and about 0% to 5% linoleic acid. A typical distribution is 2.5% myristic acid, 29% palmitic acid, 23% stearic acid, 2% palmitoleic acid, 41.5% oleic acid, and 3% linoleic acid.

Coconut oil refers to fatty acid mixtures having an approximate carbon chain length distribution of: 8% $C_8$, 7% $C_{10}$, 48% $C_{12}$, 17% $C_{14}$, 8% $C_{16}$, 2% $C_{18}$, 7% oleic and 2% linoleic acids (the first six fatty acids listed being saturated). Other sources having similar carbon chain length distributions, such as palm kernel oil and babassu kernel oil, are included within the term coconut oil. Coconut oil fatty acids ordinarily have a sufficiently low content of unsaturated fatty acids to have satisfactory keeping qualities without further treatment. Generally, however, fatty acids are hydrogenated to decrease the amount of unsaturation (especially polyunsaturation) of the fatty acid mixture.

The compositions herein generally take the form of a toilet bar wherein the soap is at least partially in beta-phase form. Beta-phase soap crystals have a smaller lattice dimension than delta and omega soap phases and are associated with a typifying 6.35 cm X-ray diffraction ring, the relative amount of beta-phase being determined by comparing the ring intensity against that of known standard mixtures. In preferred embodiments, therefore, the soap is at least about 20%, more preferably at least about 50% and especially at least about 70% in the beta-phase form. Moreover, the toilet bar compositions herein are transparent or translucent, preferably having a transluency voltage (see U.S. Pat. No. 2970116 and EP-A-0014502) of less than about 110, preferably less than about 60, more preferably less than about 45. It is a feature of the present invention that the specified clay materials can be incorporated in such bars without substantially impairing transparency or transluency. Highly preferred compositions herein are milled toilet bars.

The soap fat stock for making bars which are predominantly beta-phase is of some importance and desirably the fat stock comprises no more than about 40% thereof of saturated fatty acids of less than 16 carbon atoms and at least about 20% thereof of saturated fatty acids of from 16 to 22 carbon atoms. In preferred compositions, the fat stock comprises no more than about 30% of the shorter chain saturated fatty acids and at least about 70% of the longer chain saturated fatty acids. The moisture content of the finished beta-phase bar is generally from about 15% to about 26% by weight, preferably from about 20% to about 24%.

A further essential component of the toilet bar compositions is a smectite-type clay. Appropriate clay materials for use herein can be selected by virtue of the fact that smectites exhibit a true 14 A X-ray diffraction pattern. The clay is added generally at a level of at least 0.1% by weight of the composition and is preferably from about 0.5% to about 10%, more preferably from about 1% to about 6% by weight of composition. Preferred clays are the sodium and calcium montmorillonites (sodium and calcium here designating the predominant inorganic cation of the clay), saponites and hectorites. The particle size distribution of the clay is preferably such at least 95% by weight of the clay has a particle size of less than 297 micrometers.

While any of the above smectite-type clays can be incorporated in the compositions of the invention, particularly preferred smectite-type clays have ion-exchange capacities of at least 50 meq/100 g clay, more preferably at least 70 meq/100 g [measured, for instance, as described in 'The Chemistry and Physics of Clays', p.p 264–265, Interscience (1979)]. An especially preferred material is sodium montmorillonite clay having an ion-exchange capacity of about 85 to 90 meq/100 g supplied by Colin Stewart Minerals Ltd of Winsford Cheshire England. Other suitable clays are as follows:

Sodium Montmorillonite
- Brock
- Volclay BC
- Gelwhite GP
- Mineral Colloid No. 101
- Ben-A-Gel
- Imvite Sodium Hectorite
- Veegum F
- Laponite SP Sodium Saponite
- Barasym NAS 100

Calcium Montmorillonite
- Soft Clark
- Gelwhite L

Lithium Hectorite
- Barasym LIH 200

In addition to the components described above, the toilet bars of the present invention can contain a wide variety of optional materials. These optional materials include, for example, skin conditioning components, processing aids, anti-bacterial agents and sanitizers, dyes, perfumes and coloring agents.

Materials to facilitate the preparation of the instant toilet bars can also be present. Thus, glycerine, for example, can be added to the crutcher or amalgamator in order to facilitate processing. Glycerine, if present, generally comprises from about 0.2% to about 10% by weight of the finished bar. Additionally, emulsifiers such as polyglycerol esters (e.g. polyglycerol monostearate), propylene glycol esters and other chemically stable nonionic materials may be added to the bars to help solubilize various components, particularly skin conditioning agents, such as sorbitan esters.

Conventional anti-bacterial agents and sanitizers can be added to the bars of the present invention. Typical anti-bacterial sanitizers include 3,4-di- and 3',4',5-tris-bromosalicyl-anilides; 4,4'-dichloro-3-(trifluoromethyl)-carbanalide; 3,4,4'-tri-chlorocarbanalide and mixtures of these materials. Use of these materials in soap bars is described in more detail in U.S. Pat. No. 3,256,200. If present, anti-bacterial agents and sanitizers generally comprise from about 0.5% to about 4% by weight of the finished bar.

The bars of the present invention can optionally contain various emollients and skin conditioning agents. Materials of this type include, for example, sorbitan esters, such as those described in U.S. Pat. No. 3,988,255, lanolin, cold cream, mineral oil, isopropyl myristate, and similar materials. If present, such emollients and skin conditioning agents generally comprise from about 0.5% to about 5% by weight of the bar.

The toilet bars herein can also contain an electrolyte as described in U.S. Pat. No. 2686761 and EP-A-14502. Suitable electrolytes include sodium chloride, potassium chloride, potassium carbonate, dipotassium monohydrogen orthophosphate, tetrasodium pyrophosphate, tetrapotassium pyrophosphate, sodium tripolyphosphate, potassium tripolyphosphate, trisodium orthophosphate, tripotassium orthophosphate, and sodium and/or potassium formates, citrates, acetates and tartrates, and mixtures of the above. The electrolyte level can be from about 0.2% to about 4.5%.

The toilet bars of the invention can also contain free fatty acids, in addition to the neutralized fatty acids which form the actual soap component. Free fatty acids are especially valuable as plasticizers. Without the free fatty acids, some bars have a greater tendency to form wet cracks. The free fatty acid content should be restricted to less than about 1%–2% by weight, however.

Acidic materials can be added to the bar to control free alkalinity. A suitable example is citric acid added at a level of about 0.1% to about 3%.

Another desirable ingredient of the compositions of the invention is a pearlescent material such as mica, titanium-dioxide coated mica, natural fish silver, or heavy metal salts such as bismuth oxychloride. It is a feature of the invention that the clay described herein can be incorporated in such compositions without detriment to the development of pearlescence.

The toilet bars can also contain any of the conventional perfumes, dyes and coloring agents generally utilized in commercially-marketed bars to improve the characteristics of such products. If present, such perfumes, dyes and coloring agents comprise from about 0.2% to about 5% by weight of the bar.

The compositions of the invention are prepared in conventional manner, either from neat kettle soap or from saponified touch-hardened fatty acid blends. In a typical process, neat kettle soap containing from about 28% to about 34%, preferably from about 30% to about 32% moisture is dried, preferably by Mazzoni spray drying, to a moisture content of from about 15% to about 26%, preferably from about 19% to about 25%, more preferably from about 21% to about 23% by weight of the soap mix and the dried soap is mechanically worked at an elevated temperature, for example, in an amalgamator or over milling rolls, until the temperature is raised into the range from about 27° C. to about 51° C., preferably from about 37° C. to about 43° C., more preferably from about 39° C. to about 41° C. Thereafter, the soap mass is plodded into bar form. The clay component and optional bar components, other than perfume, dye and pearlescer, are preferably admixed with the neat kettle soap prior to the drying stage. If added after the drying stage, the clay is preferably added as an aqueous slurry.

EXAMPLES I TO VI

Soap bar compositions according to the invention are prepared as described above in which sodium tallow/coconut (80/20) kettle soap is mixed with all remaining ingredients, apart from perfume, dye, $TiO_2$ and mica, the mixture is dried in a Mazzoni spray dryer, the dried soap mixture is admixed with the remaining components in an amalgamator, then milled at about 40° C. to optimize beta-phase soap formation, and finally plodded into bar form. The compositions are as follows:

| | I | II | III | IV | V | VI |
|---|---|---|---|---|---|---|
| Sodium tallow/coconut (80/20) soap (anhydrous) | 60 | 70.3 | 66.6 | 68.5 | 69.8 | 61.5 |
| Potassium cocoate soap | 4 | — | — | 3 | — | 4 |
| Tripotassium citrate monohydrate | 2.5 | 2 | 2.5 | 1.5 | — | 3 |
| Sodium chloride | 0.4 | 0.8 | 0.4 | 0.3 | 0.6 | 0.5 |
| Glycerine | 4 | 7 | 4 | — | 5 | 5 |
| EDTA | 0.2 | 0.3 | 0.2 | 0.1 | 0.2 | 0.1 |
| Lauric Acid | 0.8 | 0.2 | 0.8 | 0.5 | 0.6 | 1 |
| $TiO_2$ coated mica | 0.1 | 0.1 | 0.1 | 0.1 | 0.1 | — |
| $TiO_2$ | — | — | — | — | 0.2 | — |
| Perfume and dye | 2 | 1.3 | 1.4 | 1 | 2.2 | 1.9 |
| Clay[1] | 4 | 1 | 2 | 3.5 | 5 | 3 |
| Moisture | 22 | 17 | 22 | 21.5 | 23 | 20 |

[1]Sodium montmorillonite having an ion-exchange capacity of from 85 to 90 meg/100 g, supplied by Colin Stewart Minerals Ltd of Winsford, Cheshire, England.

The above compositions are beta-phase, translucent toilet soaps delivering improved skin-conditioning characteristics on both oily and oily/dry combination skin types, together with excellent bar appearance (transluency), smear and lathering characteristics.

The examples are repeated with the clay being added as a 50% aqueous slurry after the drying operation. Essentially equivalent results are obtained.

What is claimed is:

1. A transparent or translucent toilet bar composition incorporating from about 0.5% to about 10% smectite-type clay, said toilet bar containing from about 45% to about 95% of a soluble alkali metal soap of $C_8$–$C_{24}$ fatty acids and from 0% to about 45% of a synthetic anionic surfactant, at least about 50% of said soap being in the beta-phase.

2. A composition according to claim 1 wherein the smectite-type clay is selected from the group consisting of sodium and calcium montmorillonites, hectorites and saponites.

3. A composition according to claim 2 wherein the smectite-type clay exhibits a 14 Å X-ray diffraction pattern.

4. A composition according to claim 2 wherein at least about 70% by weight of the soap is in the beta-phase.

5. A composition according to claim 4 comprising soap of a fat stock no more than about 40% of which are saturated fatty acids of less than 16 carbon atoms and at least about 20% of which are saturated fatty acids of from 16 to 22 carbon atoms.

6. A composition according to claim 5 having a water content of from 15% to 26% by weight.

7. A composition according to claim 2 comprising from about 1% to about 6% clay.

8. A transparent or translucent milled toilet bar composition comprising from about 55% to about 88% of soluble alkali metal soap of $C_8$ to $C_{24}$ fatty acids, from 0% to about 35% of synthetic anionic surfactant, and from about 0.1% to about 10% of smectite-type clay selected from sodium and calcium montmorillonites, hectorites and saponites, wherein at least 70% by weight of the soap is in the beta-phase.

* * * * *